United States Patent [19]

Baumgartner et al.

[11] Patent Number: 4,795,326

[45] Date of Patent: Jan. 3, 1989

[54] ROTARY PISTON MACHINE HAVING INNER AND OUTER ROTORS AND A REINFORCING BELT

[75] Inventors: Hans Baumgartner, Viersen; Klaus Heikrodt, Krefeld; Werner Seifert, Korschenbroich, all of Fed. Rep. of Germany

[73] Assignee: Pierburg GmbH, Neuss, Fed. Rep. of Germany

[21] Appl. No.: 144,518

[22] Filed: Jan. 15, 1988

[30] Foreign Application Priority Data

Jan. 15, 1987 [DE] Fed. Rep. of Germany ..... 3700954

[51] Int. Cl.[4] ..... F01C 1/10; F01C 21/00; F04C 18/10

[52] U.S. Cl. ..... 418/152; 418/168

[58] Field of Search ..... 418/152, 168, 169, 178; 29/156, 4 R

[56] References Cited

U.S. PATENT DOCUMENTS 2,053,919 9/1936 Pigott ..... 418/168
2,458,958 1/1949 Pigott et al. ..... 418/168
4,209,286 6/1980 Schwartz ..... 418/152
4,735,561 4/1988 Wankel ..... 418/168

*Primary Examiner*—John J. Vrablik
*Attorney, Agent, or Firm*—Roberts, Spiecens & Cohen

[57] ABSTRACT

A rotary piston machine has inner and outer rotors rotating at unequal speeds around eccentric axes, and the rotors are provided with angularly spaced profiled teeth and gaps which cooperate during rotation to define working chambers of varying volume which move between an inlet and an outlet for a fluid medium to be pumped. The outer rotor has openings therein to provide communication between the working chambers and the inlet and outlet during rotation of the rotors, and these openings are spaced axially of the outer rotor to define a solid band of material between the openings. The solid band of material is provided with a circumferential groove in which a reinforcing belt is mounted having greater strength than the material of the outer rotor. The belt can be glass, carbon or aramide fiber would as threads and impregnated with a hardened plastic such as an epoxy resin.

7 Claims, 2 Drawing Sheets

ROTARY PISTON MACHINE HAVING INNER AND OUTER ROTORS AND A REINFORCING BELT

FIELD OF THE INVENTION

The invention relates to improvements in a rotary piston machine of the type having inner and outer rotors rotating at unequal speeds around eccentric axes, the rotors being provided with angularly spaced profiled teeth and gaps which cooperate during rotation to define working chambers of varying volume which move between an inlet and an outlet for a fluid medium to be pumped.

DESCRIPTION OF THE PRIOR ART

A rotary piston machine of the above type is known from DE-OS No. 15 03 560 and is suitable for use as a supercharger for internal combustion engines in which the rotors are preferably made of drawn sheet-metal shapes or tubes in which a precise calibration is possible by drawing dies and an exact centering by mounting end pieces on the rotors.

In this arrangement the rotary piston machine has a greater structural width for increasing rotor diameters and is suitable for high speeds of rotation. It has the disadvantage, however, of axial introduction and discharge of the pumping medium, as a result of which long paths of travel are established for the pumping medium. This is disadvantageous from the viewpoint of economic operation at high speeds of rotation.

DE-AS No. 24 56 252 shows a rotary piston machine which has openings in the wall surface of the outer rotor, whereby short paths can be obtained for the inflowing and outflowing pumping medium. The openings are interrupted by peripheral bands in the outer surface so as to obtain a greater strength of the outer rotor. In this case, steel of high heat strength is required as the material of the outer rotor.

For a lightweight construction which is desirable in automotive vehicles, i.e by using aluminum or magnesium alloys, this is unsuitable since these light weight materials do not have sufficient strength to withstand deformation of the outer rotor during the pumping operation so as to prevent the rotor from striking against the outer housing and causing the destruction of the machine.

SUMMARY OF THE INVENTION

An object of the present invention is to provide improvements in a rotary piston machine by which the machine is strengthened so that deformations caused by temperature and centrifugal force are kept within preestablished limits and operation at very high speeds of rotation is then possible with reductions in size and weight.

The above and further objects of the invention are achieved by providing a circumferential groove in a solid band of material located between openings which are spaced axially of the outer rotor and mounting a reinforcing belt in said groove having greater strength than the material of the outer rotor.

To achieve the above, in accordance with the invention, the belt can be made of glass, carbon or aramide fiber.

According to a feature of the invention, the fiber can be wound as threads to form the belt.

According to a further feature of the invention, the threads can be impregnated with a hardenable plastic, such as a plastic having an epoxy resin base.

The fiber preferably has a coefficient of thermal expansion which is less than that of the material of the outer rotor, and the coefficient can even be negative so that the material will shrink when heated. As a consequence, temperature expansion of the outer rotor can be suppressed.

The invention will next be described with reference to a specific embodiment thereof.

DETAILED DESCRIPTION OF A PREFERRED EMBODIMENT

Figure 1:
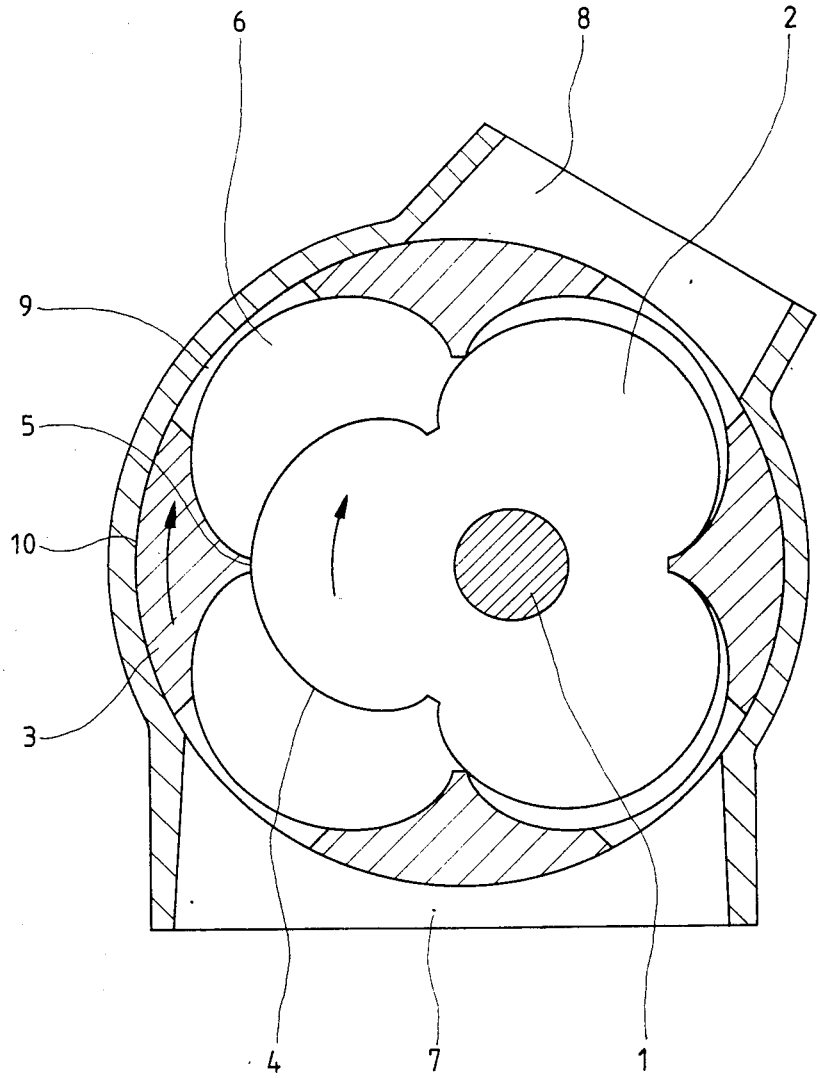
FIG. 1 is a transverse sectional view through a rotary piston machine.

FIG. 1 shows a rotary piston machine having an inner rotor 2 mounted on an inner rotor shaft 1 and an outer rotor 3 mounted eccentrically for rotation with respect to inner rotor 2. The rotors 2 and 3 respectively include profiled teeth 4, 5 which roll on one another as the rotors rotate and cooperatively form working chambers in the gaps 6 between the profiled teeth 5 of the outer rotor 3. The working chambers travel, with change in volume, during rotation of the inner and outer rotors 2, 3, between an inlet 7 and an outlet 8 for a fluid medium to be pumped. The speeds of rotation of the inner and outer rotors 2, 3 are in inverse ratio to their number of teeth, i.e. the inner rotor 2 turns four times when the outer rotor 3 turns three times. In order to avoid friction between the flanks of the profiled teeth, the rotors 2, 3 are coupled to each other by a pair of gear wheels (not shown).

The outer rotor 3 has radial openings 9 which permit inflow and outflow of the fluid medium being pumped into the tooth gaps or working chambers 6 whenever the openings 9 are uncovered from a housing 10 which partially surrounds the outer rotor 3 and the openings 9 come into communication with the inlet 7 or outlet 8.

Figure 2:
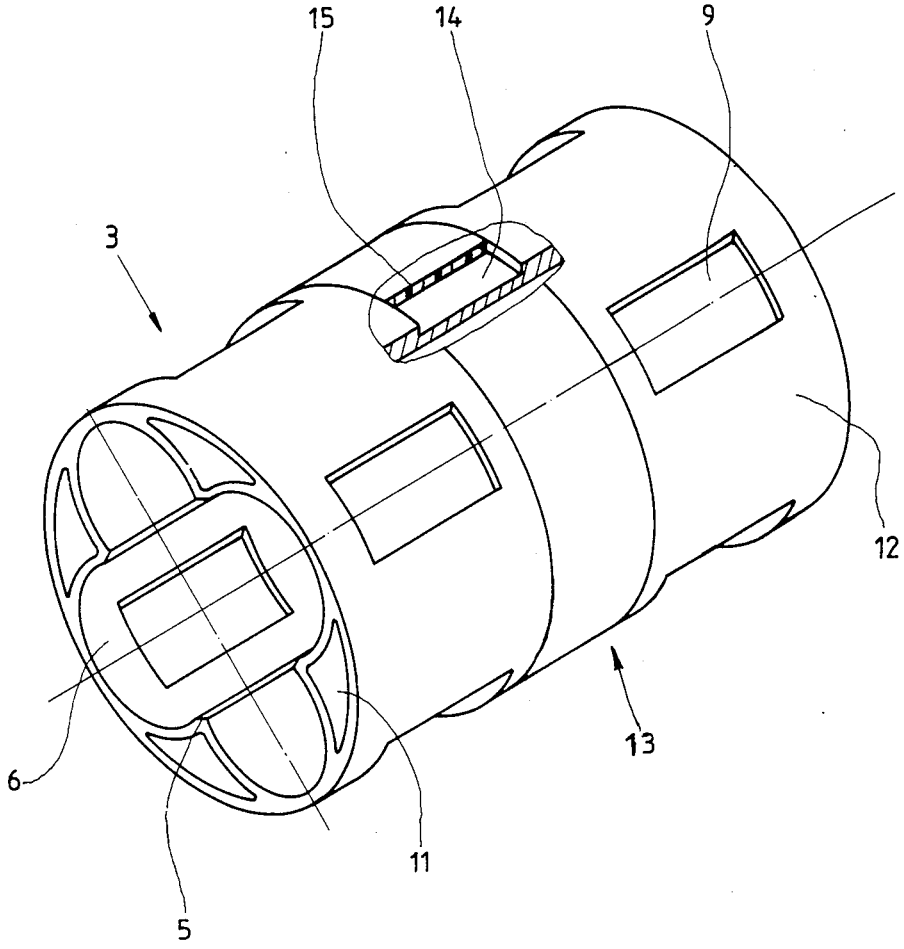
FIG. 2 is a perspective view, partly broken away and in section, of an outer rotor of the piston machine of FIG. 1 without its end walls.

FIG. 2 shows the outer rotor 3, which is made, in known manner, of pressed, drawn or cast material, as/an individual part. The rotor 3 is shown without its end walls. The inner contour of rotor 3 forms the profiled teeth 5 and gaps 6 and teeth 5 are provided with cutout 11 for reducing the amount of material and the consequent weight of the rotor.

Between the openings 9 which are arranged in axially spaced groups, there remains a band 13 of solid material at the outer periphery of the rotor. A circumferential groove 14 is formed in the outer surface of the rotor 3 in the band 13. A continuous belt 15 is mounted in groove 14, the belt being made of a glass, carbon or aramide fiber. The fiber is preferably wound as a thread of fabric and impregnated with a hardened plastic, such as an epoxy resin. The belt 15 serves as a reinforcement for rotor 3 as it has greater strength than the material of the rotor. Morever, the belt has a coefficient of thermal expansion which is less than that of the material of the rotor 3 to minimize dimensional change of the rotor when it is heated in operation. The belt can even be made of material which undergoes shrinkage when heated to intensify its action in resisting thermal expansion of the rotor 3.

The side walls of the rotor 3 which have not been shown can be affixed to the rotor by threading or welding.

DESCRIPTION OF A BEST MODE

In a particular embodiment of the invention, the belt 15 is made of carbon fiber impregnated with epoxy resin. The belt 15 has a thickness of 0.5 mm. and it is fitted in groove 14 whose depth is equal to the thickness of belt 15 so that the belt lies flush with the outer surface 12 of the rotor. The axial spacing between the closer edges of the openings 9 is 5.5 cm. and the groove 14 has a width measured axially of 5.0 cm. The width groove 14 is preferably between 80% and 100% of the axial spacing between the edges of the openings. The belt 15 has a width substantially equal to that of the groove 14.

Although the invention has been described in connection with a specific embodiment thereof, it will apparent to those skilled in the art that numerous modifications and variations can be made without departing from the scope and spirit of the invention as defined in the attached claims.

What is claimed is:

1. In a rotary piston machine having inner and outer rotors rotating at unequal speeds around eccentric axes, the rotors being provided with angularly spaced profiled teeth and gaps which cooperate during rotation to define working chambers of varying volume which move between an inlet and an outlet for a fluid medium to be pumped, the improvement wherein said outer rotor has openings therein to provide communication between the working chambers and the inlet and outlet during rotation of the rotors, said openings being spaced axially of said outer rotor to define a solid band of material between the openings, said solid band being provided with a circumferential groove, and a reinforcing belt mounted in said groove and having greater strength than the material of the outer rotor.

2. The improvement as claimed in claim 1 wherein said belt comprises glass, carbon or aramide fiber.

3. The improvement as claimed in claim 1 wherein said belt comprises wound threads of fiber material.

4. The improvement as claimed in claim 3 wherein said belt further comprises a hardened plastic filling spaces between the wound threads of material.

5. The improvement as claimed in claim 4 wherein said hardened plastic is an epoxy resin.

6. The improvement as claimed in claim 3 wherein the fiber material of said threads has a coefficient of thermal expansion which is less than that of the material of the outer rotor.

7. The improvement as claimed in claim 6 wherein the coefficient of thermal expansion of the fiber material is negative whereby the material shrinks when heated.

* * * * *